US005863041A

United States Patent [19]

Boylan et al.

[11] Patent Number: 5,863,041

[45] Date of Patent: Jan. 26, 1999

[54] PAI GOW POKER WITH AUXILIARY GAME

[75] Inventors: Eugene B. Boylan, Minden; Robert F. Koerner, Gardnerville; Russell R. Hebert, Carson City, all of Nev.

[73] Assignee: Bet Technology, Inc., Carson City, Nev.

[21] Appl. No.: 988,669

[22] Filed: Dec. 11, 1997

[51] Int. Cl.[6] ..... A63F 1/00

[52] U.S. Cl. ..... 273/292

[58] Field of Search ..... 273/292, 274; 463/13

[56] References Cited

U.S. PATENT DOCUMENTS

| | | | |
|---|---|---|---|
| 5,042,818 | 8/1991 | Weingardt | 463/13 |
| 5,560,613 | 10/1996 | Nguyen | 273/292 |
| 5,584,486 | 12/1996 | Franklin | 273/292 |

OTHER PUBLICATIONS

"Seven Card Stud Poker", Scarne's Encyclopedia of Games, John Scarne, Harper & Row Publihers, p. 41, Dec. 1973.

*Primary Examiner*—Benjamin H. Layno

*Attorney, Agent, or Firm*—Larson & Taylor

[57] ABSTRACT

A method of playing a pai gow poker wagering game in which an ante bet is initially wagered and a bonus bet is also wagered by at least one player. Seven cards are then dealt to each player and the dealer, and arranged into a two-card hand and a five-card hand. The ante bet of each player is then paid off to in the usual manner for pai gow poker. Thereafter, a best poker hand is arranged by the dealer for each player from the seven cards initially dealt to the player, and the bonus bet is paid off if the best poker hand has a poker rank equal to or better than a first predetermined rank (straight) but less than a second predetermined rank (royal flush). Next, the dealer determines whether the best poker hand of each player has a poker rank better than or equal to the second predetermined rank so that an auxiliary game of chance, such as rolling three dice, is then played to determine whether the bonus bet is paid off at a first payoff where the player is a loser or at a second payoff higher than the first payoff. In addition, the dealer then determines whether each player has made an bonus bet of a predetermined minimum, which is then paid off if any other player has a best poker hand equal to or better than a third predetermined rank (four of a kind).

12 Claims, 1 Drawing Sheet

PAI GOW POKER WITH AUXILIARY GAME

FIELD OF THE INVENTION

The present invention relates generally to a method of playing the game of pai gow poker, and more particularly to a method of playing a game of pai gow poker in which a best five card hand is also determined and an auxiliary game is played if the best five card hand has greater than a predetermined poker rank.

BACKGROUND OF THE INVENTION

Disclosed in U.S. Pat. No. 5,584,486 (Franklin) is a pai gow poker game with an additional jackpot wager. As disclosed therein, the usual game of pai gow poker in a casino setting is played by a dealer dealing each player (preferably six) and the dealer seven cards. Each player then arranges the seven cards into a two-card (Low) hand and a five card (High) hand, as does the dealer thereafter. Each player wagers an ante bet against the dealer. This ante bet is: won if both the respective Low hand and the High hand have a poker rank greater than the respective poker ranks of the Low hand and High hand of the dealer; lost if both the respective Low hand and the High hand have a poker rank less than the respective poker ranks of the Low hand and High hand of the dealer; and pushed if only one of the respective Low hand and the High hand has a poker rank greater than the respective poker ranks of the Low hand and High hand of the dealer. In this game, ties go to the dealer, and a joker is used in the play which can be used as an ace or to complete a straight or flush.

According to the improved method of play of pai gow in U.S. Pat. No. 5,584,486, an additional jackpot wager is optionally made by each player. The player wins this jackpot wager at odds when the Low hand and High hand together have a predetermined value (such as a pair and straight, or higher High hand). The odds increase in view of the rarity of the possible two hands, up to, for example, 50,000/1 for five aces and a pair.

Another modification of the pai gow poker game has been played at "Harvey's Resort and Casino" in Tahoe, Nev. In this modified game, a bonus bet is made (in addition to the ante bet in the usual game for the five-card hand and two-card hand ranks to be compared with those of the dealer). This bonus bet is won at odds if the player has any five cards (or best poker hand) which together rank above a straight (with the odds increasing for increasingly ranked hands). In addition, if a player makes a bonus bet above $5, that player can additionally win a predetermined payoff if any other player has any five cards which together form a poker rank above four of a kind (with the payoff increasing for increasingly ranked hands).

While such pai gow games are entertaining and useful in the gaming industry to increase interest and betting, games with still more betting or interest are desirable.

SUMMARY OF THE INVENTION

In accordance with the present invention, a method of playing a pai gow poker game with wagers between a group of respective players and a dealer whose outcome is determined by randomly generated playing cards having various ranks and suits is provided. In this method, an ante bet is initially wagered by each respective player against the dealer, and a bonus bet is also wagered by at least one of the respective players. Seven cards are then dealt by the dealer to each player and the dealer. The seven cards dealt to each player are then arranged by that player into a two-card hand and a five-card hand, as are the seven cards dealt to the dealer by the dealer. The ante bet of each player is then paid off to (a) the respective player if both the two-card hand and the five-card hand of the player have a higher poker rank than the respective two-card hand and five-card hand of the dealer, (b) the dealer if both the two-card hand and the five-card hand of the player have a lower poker rank than the respective two-card hand and five-card hand of the dealer, or (c) neither the o player or the dealer if only one of the two-card hand and five-card hand of the player has a higher poker rank than the respective two-card hand and five-card hand of the dealer.

Thereafter, a best poker hand is arranged by the dealer for each player. This best poker hand consists of any selected five of the seven cards dealt to each player (and formerly comprising the two-card hand and the five-card hand). The dealer then determines whether the best poker hand of each player has a poker rank equal to or better than a first predetermined poker rank but less than a second predetermined poker rank, and pays off the bonus bet by that player if that player has a best poker hand ranked equal to or better than the first predetermined poker rank but less than the second predetermined poker rank. Next, the dealer determines whether the best poker hand of each player has a poker rank better than or equal to the second predetermined poker rank. An auxiliary game of chance is then played by each player having a best poker hand better than or equal to the second predetermined poker rank to determine whether each player is a winner or loser of the auxiliary game. The bonus bet is paid off to each player having a best poker hand ranked better than or equal to the second predetermined poker rank at a first payoff where the player is a loser in the auxiliary game and at a second payoff higher than the first payoff where the player is a winner of the auxiliary game.

In addition, the dealer further determines whether each player has made an bonus bet of a predetermined minimum, which bonus bet thus qualifies as an envy bet. Each such envy bet by each player is then paid off if any other player has a best poker hand equal to or better than a third predetermined poker rank.

In a preferred embodiment, the playing of an auxiliary game includes the step of rolling three dice by each player having a best poker hand better than or equal to the second predetermined poker rank. Then the paying off of the bonus bet step includes paying off at the first payoff where the three dice rolled are not all the same value and paying off at the second payoff higher than the first payoff where the three dice rolled are all of identical value.

In the preferred embodiment, the first predetermined poker rank is a straight, the second predetermined poker rank is a royal flush, and the third predetermined poker rank is four of a kind. Further, the second payoff is at least four times greater than the first payoff.

It is an advantage of the present invention that a pai gow poker game with increased interest and betting is provided.

Other features and advantages of the present invention are stated in or apparent from detailed descriptions of presently preferred embodiments of the invention found hereinbelow.

DESCRIPTION OF THE PREFERRED EMBODIMENTS

Figure 1:
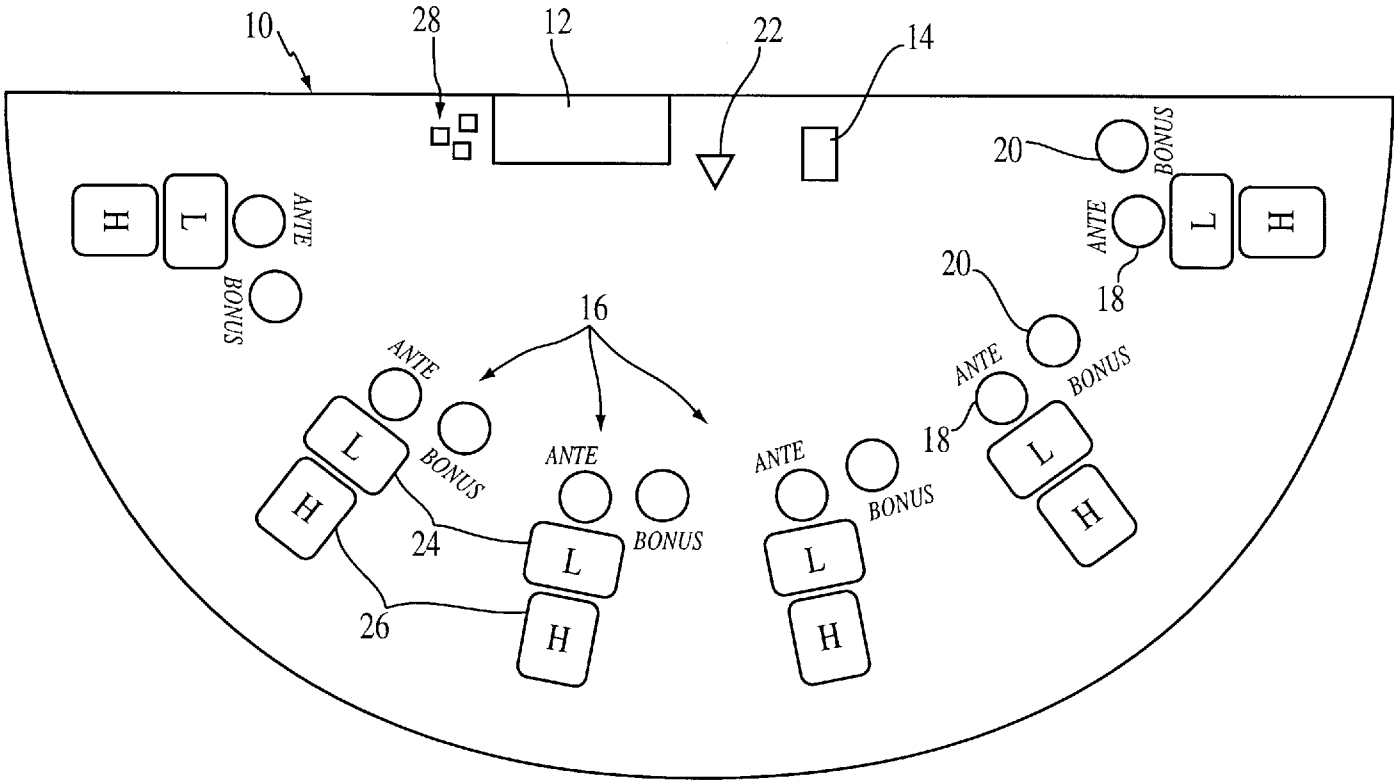
FIG. 1 is a schematic plan view of a gaming table surface for use with the method of the present invention.

With reference now to the drawing in which like numerals represent like elements, the method of play of the modified pai gow poker game will be explained with reference to a table surface 10 depicted in FIG. 1. The method of play of the pai gow game of the present invention is designed for casino type wagering games, in which the wagers are made by each player against a dealer/banker representing the casino using suitable tokens or the like. In this case, the dealer is located along the straight part of surface 10, and the dealer has a token holder or bank 12 at the dealer's disposal. Of course, other types of banker based games are possible as known in the art, such as where the dealer is not necessarily the banker. As with the usual game of pai gow, the modified pai gow game is also played with a single deck of cards 14 having the usual 52 cards in four suits and values and also including a joker mixed in so that there are 53 cards all together. As in the usual pai gow poker game, the joker is used, at the player's discretion, as either an ace or a fill-in card for a straight or a flush.

Each participating player sits behind a respective player display 16 on which wagers are made and the cards dealt and arranged. Each player display 16 includes an ante wagering area 18 on which the ante bet of each participating player is made. Preferably, the ante bet must be a predetermined minimum, such as $1. Adjacent ante wagering area 18 is a bonus wagering area 20. Each player making an ante bet is also afforded the opportunity to place a bonus bet in this area, which bonus bet must also be above a predetermined minimum such as $1. In addition, where the bonus bet is above a predetermined minimum, such as $5, this signifies that an envy bet has also been made. Where this occurs, the dealer places a suitable lamer 22 in front of such a bonus wager qualifying as an envy bet. Usually, maximum wagers are also designated by the house.

The method of play of the modified pai gow game of the present invention is as follows. Initially, each participating player places an ante bet in area 18, and LO optionally a bonus bet in area 20. After all bets are placed and the dealer has appropriately shuffled the deck of cards 14, and had the deck cut if desired, seven cards are dealt to each of the players making an ante bet. Each player then arranges the seven cards dealt to them as a two-card hand which is placed in a two-card area 24 (labeled "L" to represent the low or two-card hand), and as a five-card hand which is placed in a five-card area 26 (labeled "H" to represent the high or five-card hand). After all players have arranged their hands, the dealer arranges its hand in the same manner in front of bank 12.

Once the dealer's hands are arranged, the dealer immediately pays off in turn each ante bet of the players as follows: (a) to the respective player if both the two-card hand and the five-card hand of the player have a higher poker rank than the respective two-card hand and five-card hand of the dealer, (b) to the dealer if both the two-card hand and the five-card hand of the player have a lower poker rank than the respective two-card hand and five-card hand of the dealer, or (c) to neither the player or the dealer if only one of the two-card hand and five-card hand of the player has a higher poker rank than the respective two-card hand and five-card hand of the dealer, so that the ante bet remains as a push for the next round of the pai gow poker game. As with prior art pai gow games, a hand of a player which ties a hand of the dealer is considered as a win for the dealer.

After all ante bets are paid off, the dealer in turn arranges a best poker hand for each player selected from the seven cards dealt to each player and then located in areas 24 and 26. Thereafter, the dealer again in turn determines whether the best poker hand of each player has a poker rank equal to or better than a first predetermined poker rank and less than a second predetermined poker rank. Preferably, the first predetermined poker rank is a straight and the second predetermined poker rank is a royal flush. For hands less than the first predetermined poker rank, any bonus bet is lost by that player; while for any bonus bet within the predetermined range (equal to a straight but less than a royal flush), that player is a winner of the bonus bet and is paid off according to a predetermined schedule of odds (set forth below).

If the best poker hand is equal to or better than the second predetermined poker rank, in the present example such a hand would be either a royal flush or five of a kind, the player is required to play a quick auxiliary chance game to determine if the bonus bet will be paid off at first odds or at an increased second odds. In the preferred embodiment, the auxiliary game is the rolling of three dice 28 by the player having a best poker hand better than or equal to the second predetermined poker rank. If all three dice rolled by the player do not have the same value, then the player is a loser of the auxiliary game and the bonus bet is paid off at a first payoff; however, if all three dice have the same value, that player is a winner of the auxiliary game and the bonus bet is paid off at a second payoff greater than the first payoff (such as four or more times greater).

In the preferred embodiment, the payoffs for the various winning best poker hands are approximately as follows:

| | |
|---|---|
| five of a kind and winner of auxiliary game | 8000 to 1 |
| royal flush and winner of auxiliary game | 800 to 1 |
| five aces (not winner of auxiliary game) | 600 to 1 |
| royal flush (not winner of auxiliary game) | 150 to 1 |
| straight flush | 50 to 1 |
| four of a kind | 25 to 1 |
| full house | 5 to 1 |
| flush | 4 to 1 |
| three of a kind | 3 to 1 |
| straight | 2 to 1. |

Each best poker hand less than a third predetermined poker rank, preferably less than four of a kind, is collected by the dealer after paying off of the bonus bet (if any). However, best poker hands equal to greater than the third predetermined minimum are left on surface 10 in front of the player. After all best poker hands have been determined and all bonus bets have been paid off, the dealer determines which players have also qualified for an envy bet (by making a bonus bet above a predetermined minimum, such as $5 as discussed above) and thus which players have a lamer 22 in front of that player's display 16. For each player with a lamer 22, a payoff is made for each other player who has a best poker hand equal to or greater than the third predetermined poker rank (four of a kind).

No payoff is made for the player with the lamer and the best poker hand equal to or greater than the third predetermined poker rank, as that player has already benefited from that best poker hand by a payoff at odds on that player's bonus bet as noted above. However, the envy bet affords the opportunity to bet that a fellow player will have a best poker hand equal to or greater than the third predetermined poker rank, and thus this adds interest to the game as each player will have an interest in the hands of the other players and potentially in whether that player wins an auxiliary game. It will be noted that the seven cards of the dealer are not arranged into a best poker hand.

The preferred payoffs for each qualifying envy bet with respect to the predetermined minimum to qualify for the envy bet, for each best poker hand equal to or better than the predetermined third poker rank, is approximately as follows:

| | |
|---|---|
| five of a kind and winner of auxiliary game | 1,000 to 1 |
| royal flush and winner of auxiliary game | 100 to 1 |
| five aces (not winner of auxiliary game) | 50 to 1 |
| royal flush (not winner of auxiliary game) | 10 to 1 |
| straight flush | 4 to 1 |
| four of a kind | 1 to 1. |

Obviously, in the present method where the envy qualifying bet is preferably set at $5, the preferred payoffs would be predetermined dollar amounts which would be posted as follows:

| | |
|---|---|
| five of a kind and winner of auxiliary game | $5,000 |
| royal flush and winner of auxiliary game | $500 |
| five aces (not winner of auxiliary game) | $250 |
| royal flush (not winner of auxiliary game) | $50 |
| straight flush | $20 |
| four of a kind | $5. |

While the present invention has been described with respect to exemplary embodiments thereof, it will be understood by those of ordinary skill in the art that variations and modifications can be effected within the scope and spirit of the invention.

We claim:

1. A method of playing a pai gow poker game with wagers between a group of respective players and a dealer whose outcome is determined by randomly generated playing cards having various ranks and suits, said method comprising the step of:

wagering an ante bet by each respective player against the dealer;

wagering of a bonus bet by at least one of the respective players;

dealing of seven cards to each player and the dealer;

arranging of the seven cards dealt to each player by that player into a two-card hand and a five-card hand;

arranging of the seven cards dealt to the dealer by the dealer into a two-card hand and a five-card hand;

paying off of the ante bet of each player to (a) the respective player if both the two-card hand and the five-card hand of the player have a higher poker rank than the respective two-card hand and five-card hand of the dealer, (b) the dealer if both the two-card hand and the five-card hand of the player have a lower poker rank than the respective two-card hand and five-card hand of the dealer, or (c) neither the player or the dealer if only one of the two-card hand and five-card hand of the player has a higher poker rank than the respective two-card hand and five-card hand of the dealer;

arranging, by the dealer for each player, of a best poker hand consisting of any selected five of the seven cards dealt to each player and formerly comprising the two-card hand and the five-card hand;

determining, by the dealer, whether the best poker hand of each player has a poker rank equal to or better than a first predetermined poker rank but less than a second predetermined poker rank;

paying off of the bonus bet by that player if that player has a best poker hand ranked equal to or better than the first predetermined poker rank but less than the second predetermined poker rank;

determining, by the dealer, whether the best poker hand of each player has a poker rank better than or equal to the second predetermined poker rank;

playing of an auxiliary game of chance by each player having a best poker hand better than or equal to the second predetermined poker rank to determine whether each player is a winner or loser of the auxiliary game;

paying off of the bonus bet to each player having a best poker hand ranked better than or equal to the second predetermined poker rank at a first payoff where the player is a loser in the auxiliary game and at a second payoff higher than the first payoff where the player is a winner of the auxiliary game;

determining whether each player has made an bonus bet of a predetermined minimum which thus qualifies as an envy bet; and paying off of any envy bet by each player if any other player has a best poker hand equal to or better than a third predetermined poker rank.

2. A method of playing a pai gow poker game as claimed in claim 1:

wherein said playing of an auxiliary game includes the step of rolling three dice by each player having a best poker hand better than or equal to the second predetermined poker rank; and wherein said paying off of the bonus bet step includes paying off at the first payoff where the three dice rolled are not all the same value and paying off at the second payoff higher than the first payoff where the three dice rolled are all of identical value.

3. A method of playing a pai gow poker game as claimed in claim 2:

wherein the first predetermined poker rank is a straight, wherein the second predetermined poker rank is a royal flush, and the third predetermined poker rank is four of a kind.

4. A method of playing a pai gow poker game as claimed in claim 3:

wherein the second payoff is at least four times greater than the first payoff.

5. A method of playing a pai gow poker game as claimed in claim 4:

wherein said dealing step includes the mixing in of a joker card with the cards to be dealt, which joker card is usable as an ace or as a fill-in card for straights and flushes.

6. A method of playing a pai gow poker game as claimed in claim 5:

wherein the payoffs for the bonus bet are approximately as follows:

| | |
|---|---|
| five of a kind and winner of auxiliary game | 8000 to 1 |
| royal flush and winner of auxiliary game | 800 to 1 |
| five aces (not winner of auxiliary game) | 600 to 1 |
| royal flush (not winner of auxiliary game) | 150 to 1 |
| straight flush | 50 to 1 |
| four of a kind | 25 to 1 |
| full house | 5 to 1 |
| flush | 4 to 1 |
| three of a kind | 3 to 1 |
| straight | 2 to 1. |

7. A method of playing a pai gow poker game as claimed in claim 6:

wherein the payoffs for the envy bet of each player are approximately as follows, with respect to the predetermined minimum, for each other player having a best poker hand as follows:

| | |
|---|---|
| five of a kind and winner of auxiliary game | 1,000 to 1 |
| royal flush and winner of auxiliary game | 100 to 1 |
| five aces (not winner of auxiliary game) | 50 to 1 |
| royal flush (not winner of auxiliary game) | 10 to 1 |
| straight flush | 4 to 1 |
| four of a kind | 1 to 1. |

8. A method of playing a pai gow poker game as claimed in claim 1:

wherein the first predetermined poker rank is a straight, wherein the second predetermined poker rank is a royal flush, and the third predetermined poker rank is four of a kind.

9. A method of playing a pai gow poker game as claimed in claim 1:

wherein the second payoff is at least four times greater than the first payoff.

10. A method of playing a pai gow poker game as claimed in claim 1:

wherein said dealing step includes the mixing in of a joker card with the cards to be dealt, which joker card is usable as an ace or as a fill-in card for straights and flushes.

11. A method of playing a pai gow poker game as claimed in claim 1:

wherein the payoffs for the bonus bet are approximately as follows:

| | |
|---|---|
| five of a kind and winner of auxiliary game | 8000 to 1 |
| royal flush and winner of auxiliary game | 800 to 1 |
| five aces (not winner of auxiliary game) | 600 to 1 |
| royal flush (not winner of auxiliary game) | 150 to 1 |
| straight flush | 50 to 1 |
| four of a kind | 25 to 1 |
| full house | 5 to 1 |
| flush | 4 to 1 |
| three of a kind | 3 to 1 |
| straight | 2 to 1. |

12. A method of playing a pai gow poker game as claimed in claim 1:

wherein the payoffs for the envy bet of each player are approximately as follows, with respect to the predetermined minimum, for each other player having a best poker hand as follows:

| | |
|---|---|
| five of a kind and winner of auxiliary game | 1,000 to 1 |
| royal flush and winner of auxiliary game | 100 to 1 |
| five aces (not winner of auxiliary game) | 50 to 1 |
| royal flush (not winner of auxiliary game) | 10 to 1 |
| straight flush | 4 to 1 |
| four of a kind | 1 to 1. |

* * * * *